US005758712A

United States Patent [19]

Pedersen

[11] Patent Number: 5,758,712

[45] Date of Patent: Jun. 2, 1998

[54] CASTING DEVICE FOR NON-GRAVITY CASTING OF A MOULD WITH A LIGHT-METAL ALLOY THROUGH A BOTTOM INLET IN THE MOULD

[75] Inventor: Steen Pedersen, Ballerup, Denmark

[73] Assignee: Georg Fischer Disa A/S, Denmark

[21] Appl. No.: 727,650

[22] PCT Filed: May 19, 1995

[86] PCT No.: PCT/DK95/00202

§ 371 Date: Oct. 9, 1996

§ 102(e) Date: Oct. 9, 1996

[87] PCT Pub. No.: WO95/32066

PCT Pub. Date: Nov. 30, 1995

[30] Foreign Application Priority Data

May 19, 1994 [DK] Denmark ..... 0569/94

[51] Int. Cl.[6] ..... B22D 35/04

[52] U.S. Cl. ..... 164/337; 164/133

[58] Field of Search ..... 164/133, 134, 164/119, 306, 337, 167, 363

[56] References Cited

U.S. PATENT DOCUMENTS

| | | | |
|---|---|---|---|
| 3,761,218 | 9/1973 | Portalier | 164/119 |
| 4,076,070 | 2/1978 | Lefebvre et al. | 164/119 |
| 4,733,714 | 3/1988 | Smith | 164/136 |

FOREIGN PATENT DOCUMENTS

| | | |
|---|---|---|
| 1597565 | 9/1981 | United Kingdom . |
| WO 93/11892 | 6/1993 | WIPO . |

*Primary Examiner*—Kuang Y. Lin
*Attorney, Agent, or Firm*—Larson & Taylor

[57] ABSTRACT

A casting device for counter gravity casting of a light-metal alloy avoids local expansion of the mould cavity. The device includes a pump for conveying molten light metal from a holding furnace through a reservoir via a nozzle to an inlet system in a mould in order fill the mould cavity. The mean cross-sectional area of the reservoir is substantially greater than the mean cross-sectional area of the inlet in the mould. The length of the reservoir constitutes a major portion of the distance between the pump and the mold.

5 Claims, 1 Drawing Sheet

CASTING DEVICE FOR NON-GRAVITY CASTING OF A MOULD WITH A LIGHT-METAL ALLOY THROUGH A BOTTOM INLET IN THE MOULD

TECHNICAL FIELD

The invention relates to a casting device for counter-gravity casting with a light-metal alloy.

BACKGROUND ART

Such a casting device is known from the international patent application WO 93/11892. In this specification, the holding furnace is placed at a lower level than the moulds to be cast, and the electromagnetic pump can be connected to each of these moulds by means of a heated ceramic tube terminating in a nozzle which may be tight-fitting pressed around the bottom inlet in the side of the mould. Moreover, this publication describes measures for closing the bottom inlet in the mould after the casting of same, making it possible to remove the nozzle from the mould after casting with a view to casting a subsequent mould in a mould string in a mould-string plant, without the cast metal flowing out from the mould.

In this known casting device, the heated ceramic tube connecting the pump to the casting nozzle has an internal cross-section approximately corresponding to that of the bottom inlet of the mould, and a relatively large length as compared to the length of the inlet system in the mould.

As the moulds in the mould-string plant are to be cast rather rapidly, viz. within the period during which the mould string is stationary while a new mould part is being made, during the casting of the mould the metal moves at a relatively high velocity through the ceramic tube and the inlet system of the mould into the mould cavity and consequently, this moving molten mass has a rather high kinetic energy and is braked suddenly, if the flowing metal in the mould encounters a constriction, and in any case when the mould eventually is filled. While the first situation gives rise to a continuous increase of pressure within the flowing metal upstream of the constriction, the eventual filling of the mould gives rise to a momentary increase of pressure within the metal cast into the mould, a so-called "pressure surge" or "impact", which may partly effect local expansions of the mould cavity causing incorrect dimensions and shapes of the resulting casting, partly cause the metal to penetrate into the interstices between sand grains in the mould wall causing the sand grains to "burn on" to the surface of the casting, and partly may such impact cause the nozzle to be forced away from its pressure sealing abutment around the inlet, so that molten metal leaks out at this location and may cause difficulties in the closing of the bottom inlet of the mould.

DISCLOSURE OF THE INVENTION

It is the object of the invention to provide a casting device of the kind referred to initially, with which the amplitude of both the first-mentioned pressure rise and the impact at mould filling may be reduced considerably with a view to avoiding the drawbacks mentioned.

This object may be achieved in accordance with this invention by forming a reservoir in the conduit between the furnace and bottom inlet of the moulds with a cross-sectional area A substantially greater than the cross-sectional area a of the bottom of the inlet of the mould.

The effect of this is a corresponding reduction of the velocity of the flowing metal within the reservoir, while the mass of the latter correspondingly increases. This means that the kinetic energy of the flowing melt within the reservoir is approximately reduced in the ratio a:A between the two cross-sectional areas as compared to the known casting device, in which the communicating conduit is a ceramic tube with approximately the same cross-sectional area as that of the inlet system of the mould. As the length of the communicating conduit is rather large as compared to the length of the inlet system of the mould, and as the reservoir extends along a major proportion of the distance between the pump and the mould, this means a considerable reduction of the total kinetic energy of the moved melt to be braked, i.e. converted into pressure energy, at a constriction in or at filling of the mould and, consequently, of the amplitude of the resulting pressure surges or impacts.

Advantageous embodiments of the casting device according to the invention are explained in the following detailed portion of the present description.

BRIEF DESCRIPTION OF THE DRAWINGS

The present invention will be described in more detail in the following detailed portion of the specification with reference to the drawings, in which FIG. 1 highly diagrammatically shows a casting device according to the invention, and FIG. 2 in the same way as FIG. 1 shows a modified casting device according to the invention comprising a gas pocket.

DESCRIPTION OF THE PREFERRED EMBODIMENT

Figure 1:
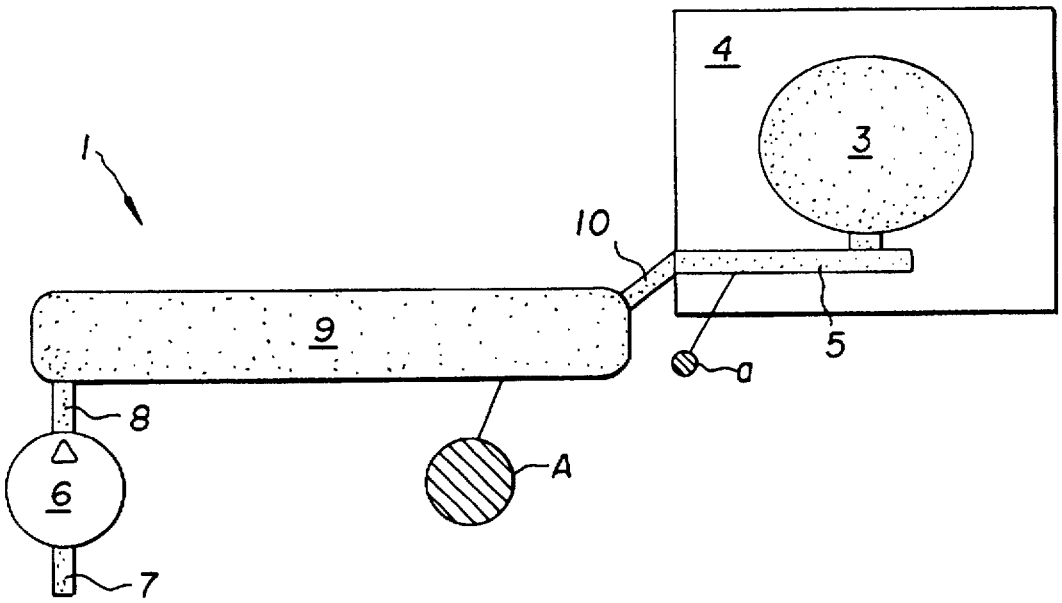

The casting device according to the invention shown in FIG. 1 and generally designated 1, is intended for casting of a mould cavity 3 in a mould 4 through a bottom inlet system 5. The mould 4, which may be a green-sand mould in a mould string in a mould-string plant, is shown as a so-called closed mould, i.e. it has no riser leading from the mould cavity 3 to the upper surface of the mould 4.

The casting device 1 comprises a holding furnace (not shown) for a light-metal alloy and a pump 6 pumping light metal from the holding furnace through an inlet port 7 and up through an outlet 8 into a reservoir 9. The pump 6 may, as described in the international patent application WO 93/11892, be an electromagnetic pump submerged in the molten light-metal alloy in the holding furnace (not shown). The reservoir 9 may be connected tight-fitting to the bottom inlet 5 of the mould 4 via a nozzle 10 with a view to casting the mould. The entire casting device is heated, e.g. electrically.

As will appear from FIG. 1, the reservoir 9 extends along a major proportion of the distance between the pump 6 and the mould 4, and likewise, the length of the reservoir 9 is substantially greater than the length of the inlet system 5 in the mould 4.

The reservoir 9 has a mean cross-sectional area A substantially greater than the mean cross-sectional area a of the inlet 5 of the mould 4. The effect of this is that during the casting of the mould 4, the velocity $v_R$ of the melt within the reservoir 9 is reduced by the factor a:A relative to the velocity $v_I$ of the melt in the inlet 5 as well as in the outlet 8 and in the nozzle 10, the latter having approximately the same cross-sectional area as the inlet 5. Admittedly, at the same time the mass $m_R$ of the melt within the reservoir 9 is increased by the factor A:a relative to the mass $m_I$ of the melt in a ceramic tube of the same length as the reservoir 9 and with the same cross-sectional area a as that of the inlet 5.

The kinetic energy $Ek_R$ of the melt within the reservoir is equal to $\frac{1}{2} \times m_R \times v_R^2$, hence reduced by the factor a:A compared to what it would be if the reservoir 9 were a ceramic tube with the same cross-sectional area a as that of the inlet 5 in the mould 4, or expressed in another way:

$$Ek_R = 1/2 \times \frac{A}{a} \times m_I \times \left( \frac{a}{A} \times v_I \right)^2 = \frac{a}{A} \times (1/2 \times m_I \times v_I^2).$$

Thus, by including the reservoir 9 in the connection 8, 9, 10 connecting the pump 6 to the mould 4, the length of said reservoir 9 constituting a major proportion of the total flow path for the metal, a considerable reduction is achieved in the total kinetic energy of the molten mass in the casting device 1 and in the mould 4, to be subjected to a braking effect when the metal flows through a constriction in the mould or by filling of the mould cavity 3 in the mould 4.

This effects a corresponding reduction of the amplitudes of the pressure surges arising, especially the pressure impact when the mould cavity 3 in the mould 4 is filled.

Figure 2:
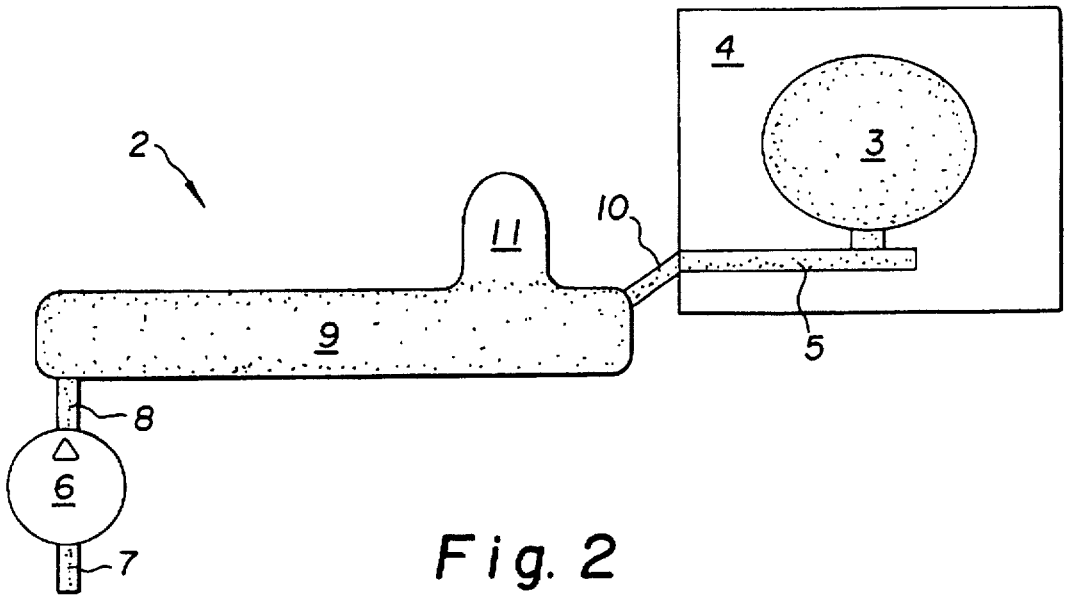

FIG. 2 shows a modified casting device according to the invention, generally designated 2, and which merely differs from the casting device 1 shown in FIG. 1 in that the reservoir 9 comprises a pocket 11 with an entrapped, inert gas. The pocket 11 is preferably disposed close to the nozzle 10. Besides, the same reference numerals indicate the same or corresponding details as in FIG. 1. The gas entrapped in the pocket 11 must be inert in the sense that it does not react chemically with or is dissolved in the molten metal.

When the flowing metal within the reservoir 9 is to be subjected to a braking effect, either because the metal in the mould has to pass a constriction in the mould, or in case of filling of the mould, at least a part of the kinetic energy in the melt within the reservoir 9 is converted into potential pressure energy in the gas pocket 11 by compressing the gas within the latter, so that the amplitude of the pressure rise thus created in the metal in the mould cavity 3 is reduced further as compared to the reduction achieved by the embodiment shown in FIG. 1.

In this embodiment of the casting device 2, it is necessary after the filling of the mould 4 and barring of the inlet 5 in the mould to reverse the pump 6 and pump metal back from the reservoir 9 into the holding furnace (not shown) until the pressure rise in the gas pocket 11 is equalized, before removing the nozzle 10 from the mould 4, or when casting moulds in a mould-string plant it is necessary to use a nozzle 10 which—as described in the international patent application WO 93/11892—is constantly in tight-fitting contact with a side-wall region of the mould string encompassing the inlets 5.

In the above description, the invention is described with an electromagnetic pump as a pressure source for moving the metal, but it will be readily understood that the moving pressure may be provided in another way, e.g. by applying pressure to the metal in the holding furnace.

I claim:

1. A casting device for counter-gravity casting with a light-metal alloy through a bottom inlet of a mould, said device comprising a holding furnace for containing the molten light-metal alloy, a pump for pumping the molten light-metal alloy from the holding furnace into said mould, and a conduit between the furnace and the bottom inlet of the mould, said conduit comprising a reservoir extending over a majority of the length of said conduit having a mean cross-sectional area of 30 to 70 times the mean cross-sectional area of the bottom inlet of the mould.

2. The casting according to claim 1, wherein the reservoir comprises a pocket for containing an entrapped gas.

3. The casting device according to claim 1, wherein said mould comprises a green-sand mould.

4. The casting device according to claim 1, wherein said pump comprises an electromagnetic pump submerged in said holding furnace.

5. The casting device according to claim 1, wherein said conduit is heated.

* * * * *